US005660928A

United States Patent [19]

Stokes et al.

[11] Patent Number: 5,660,928

[45] Date of Patent: Aug. 26, 1997

[54] SUBSTRATE FOR INK JET PRINTING HAVING A DUAL LAYER INK-RECEPTIVE COATING

[75] Inventors: Bruce George Stokes, Woodstock; Francis Joseph Kronzer, Marietta, both of Ga.

[73] Assignee: Kimberly-Clark Worldwide, Inc., Neenah, Wis.

[21] Appl. No.: 496,266

[22] Filed: Jun. 28, 1995

[51] Int. Cl.[6] ..... B41J 2/01; B41M 5/00

[52] U.S. Cl. ..... 428/331; 428/195; 428/500; 442/73

[58] Field of Search ..... 428/195, 207, 428/211, 214, 216, 330, 331, 500, 290

[56] References Cited

U.S. PATENT DOCUMENTS

| | | | |
|---|---|---|---|
| 4,440,827 | 4/1984 | Miyamoto et al. | 428/327 |
| 4,460,637 | 7/1984 | Miyamoto et al. | 428/212 |
| 4,474,850 | 10/1984 | Burwasser | 428/336 |
| 4,503,118 | 3/1985 | Murakami et al. | 428/323 |
| 4,636,410 | 1/1987 | Akiya et al. | 427/261 |
| 4,732,786 | 3/1988 | Patterson et al. | 427/261 |
| 4,770,934 | 9/1988 | Yamasaki et al. | 428/331 |
| 4,792,487 | 12/1988 | Schubring et al. | 428/342 |
| 4,830,911 | 5/1989 | Kojima et al. | 428/342 |
| 4,861,644 | 8/1989 | Young et al. | 428/195 |
| 4,877,678 | 10/1989 | Hasegawa et al. | 428/216 |
| 4,892,591 | 1/1990 | Ogawa et al. | 106/482 |
| 4,892,787 | 1/1990 | Kruse et al. | 428/331 |
| 4,900,620 | 2/1990 | Tokita et al. | 428/330 |
| 4,915,923 | 4/1990 | Ogawa et al. | 423/335 |
| 4,944,988 | 7/1990 | Yasuda et al. | 428/195 |
| 5,007,964 | 4/1991 | Tsukisaka et al. | 106/464 |
| 5,013,603 | 5/1991 | Ogawa et al. | 428/331 |
| 5,081,470 | 1/1992 | Kurabayashi | 346/1.1 |
| 5,124,201 | 6/1992 | Kurabayashi | 428/323 |
| 5,165,973 | 11/1992 | Kojima et al. | 428/331 |
| 5,180,624 | 1/1993 | Kojima et al. | 428/211 |
| 5,185,213 | 2/1993 | Fujita et al. | 428/500 |
| 5,213,873 | 5/1993 | Yasuda et al. | 428/195 |
| 5,281,467 | 1/1994 | Shimada et al. | 428/195 |
| 5,320,897 | 6/1994 | Kondo et al. | 428/195 |
| 5,364,702 | 11/1994 | Idei et al. | 428/423 |
| 5,372,884 | 12/1994 | Abe et al. | 428/331 |
| 5,478,631 | 12/1995 | Kawano et al. | 428/212 |

FOREIGN PATENT DOCUMENTS

| | | | |
|---|---|---|---|
| 0 286 427 | 10/1988 | European Pat. Off. | B41M 1/30 |
| 0 608 763 | 8/1994 | European Pat. Off. | B41M 5/00 |
| 4 330 428 | 3/1994 | Germany | D21H 19/58 |
| 59-222381 | 12/1984 | Japan . | |
| 61-57380 | 3/1986 | Japan . | |
| 61-47290 | 3/1986 | Japan . | |
| 61-63477 | 4/1986 | Japan . | |
| 61-148092 | 11/1986 | Japan . | |
| 62-268682 | 11/1987 | Japan . | |
| 62-278081 | 12/1987 | Japan . | |
| 63-28689 | 7/1988 | Japan . | |
| 63-264391 | 11/1988 | Japan . | |
| 63-274583 | 11/1988 | Japan . | |
| 63-286392 | 11/1988 | Japan . | |
| 1-36478 | 2/1989 | Japan . | |
| 1-30781 | 2/1989 | Japan . | |
| 1-95092 | 4/1989 | Japan . | |
| 1-255580 | 10/1989 | Japan . | |
| 3-33298 | 2/1991 | Japan . | |
| 4-250092 | 9/1992 | Japan . | |
| 5-221113 | 8/1993 | Japan . | |
| 6-32046 | 2/1994 | Japan . | |
| 6-92011 | 4/1994 | Japan . | |
| 6-143800 | 5/1994 | Japan . | |
| 6-158596 | 6/1994 | Japan . | |

OTHER PUBLICATIONS

Copy of Search Report for PCT/US96/10834.
Abstract for DE 43 30 428 A1.

*Primary Examiner*—Pamela R. Schwartz
*Attorney, Agent, or Firm*—William E. Maycock

[57] ABSTRACT

A coated substrate which includes a first, second, and third layer. The first layer has first and second surfaces. For example, the first layer may be a film or a nonwoven web. Desirably, the first layer will be a cellulosic nonwoven web. The second layer overlays the first surface of the first layer. The second layer is composed of from about 25 to about 70 percent by weight of a latex binder, from about 25 to about 65 percent by weight of a hydrophilic silica, from about 5 to about 20 percent by weight of a latent base, and from about 1 to about 4 percent by weight of a water-soluble viscosity modifier, in which all percents by weight are based on the total dry weight of the second layer. The third layer overlays the second layer and is composed of a water-soluble cationic polymer. Additional layers may be present, if desired.

11 Claims, No Drawings

SUBSTRATE FOR INK JET PRINTING HAVING A DUAL LAYER INK-RECEPTIVE COATING

BACKGROUND OF THE INVENTION

The present invention relates to a coated substrate.

The ink jet method of printing is a rapidly growing, commercially important printing process because of its ability to produce economical, high quality, multi-colored prints. Ink jet printing is becoming the method of choice for producing colored hard copy of computer generated images consisting of graphics and fonts in both narrow and wide format.

In general, the ink used in ink jet printing consists of an aqueous solution of dye, a humectant, and a pH buffer. These formulations are desirable because of their low cost, availability, safety, and environmental friendliness. In ink jet printing uniformly shaped droplets of the aqueous formulation are ejected from a nozzle as very small drops onto a printing substrate. The printing substrate should allow for printing of round, well-shaped dots of high optical density. The substrate should control feathering (spreading) of the ink drops and absorb the ink vehicle rapidly (fast dry time) while adsorbing the dye at the surface to give sharp high density prints. Ideally, the substrate should also "fix" the dyes (i.e., cause them to become water insoluble), so as to cause the print to be moisture and water resistant. Practically, however, it is very difficult to obtain all the above properties in one ink jet printing substrate.

There are a large number of references which relate to ink jet printable substrates. The typical substrate is a paper or other material having an ink-receptive coating. The coating typically includes one or more pigments and a binder. Pigments which have been used, alone or in combination, include, by way of illustration only, silica; clay; calcium carbonate; talc; barium sulfate; diatomaceous earth; titanium dioxide; cation-modified non-spherical colloidal silica, in which the modifying agent is aluminum oxide, hydrous zirconium oxide, or hydrous tin oxide; calcium carbonate-compounded silica; prismatic orthorhombic aragonite calcium carbonate; alumina; aluminum silicate; calcium silicate; kaolin; magnesium silicate; magnesium oxalate; magnesium-calcium carbonate; magnesium oxide; magnesium hydroxide; high-swelling montmorillonite clay; amorphous silica particles having a coating of a Group II metal; synthetic silica; and micro-powder silica. In some instances, the pigment may have certain defined requirements, such as particle diameter, oil absorption, surface area, water absorption, refractive index, and solubility in water.

Various binders have been employed to form the ink-receptive coating. Examples of such binders include, again by way of illustration only, a mixture of esterified starch and a water-insoluble cationic polymer; an epoxy resin and a thermoplastic resin; acrylic resins and other water-soluble polymers; a mixture of an alkylquaternaryammonium (meth)acrylate polymer and an alkylquaternaryammonium (meth)acrylamide polymer; poly(vinyl alcohol); a mixture of an acrylic resin and poly(vinyl alcohol); polyvinylpyrrolidone or vinylpyrrolidone-vinyl acetate copolymer or mixture thereof; an amine salt of a carboxylated acrylic resin; oxidized or esterified starch; derivatized cellulose; casein; gelatin; soybean protein; styrene-maleic anhydride resin or derivative thereof; styrene-butadiene latex; and poly(vinyl acetate).

Additional materials have been included in the ink-receptive layer, such as a cationic polymer. Moreover, two or more layers have been employed to form the ink-receptive coating.

In spite of the large number of improvements to ink jet printing substrates, there still is not a single substrate which satisfactorily produces sharp prints of brilliant color without feathering and which will not bleed when exposed to moisture or water. Thus, there is an opportunity for an improved substrate for ink jet printing which has been developed specifically to overcome the foregoing disadvantages.

SUMMARY OF THE INVENTION

The present invention addresses some of the difficulties and problems discussed above by providing an ink jet printable coated substrate which is particularly useful with colored water-based ink jet inks. The coated substrate of the present invention gives sharp prints of brilliant color without feathering. In addition, the printed images will not bleed when exposed to moisture or water.

The coated substrate of the present invention includes a first, second, and third layer. The first layer has first and second surfaces. For example, the first layer may be a film or a nonwoven web. Desirably, the first layer will be a cellulosic nonwoven web. The second layer overlays the first surface of the first layer. The second layer is composed of from about 25 to about 70 percent by weight of a latex binder, from about 25 to about 65 percent by weight of a hydrophilic silica, from about 1 to about 20 percent by weight of a latent base, and from about 1 to about 4 percent by weight of a water-soluble viscosity modifier, in which all percents by weight are based on the total dry weight of the second layer. The third layer overlays the second layer and is composed of a water-soluble cationic polymer.

In general, the hydrophilic silica will have an average particle size no greater than about 20 micrometers. For example, the hydrophilic silica typically will have an average particle size of from about 1 to about 20 micrometers. In addition, the hydrophilic silica generally will have a pore volume greater than 0.4 cubic centimeters per gram (cc/g). As an example, the pore volume of the hydrophilic silica may be from about 1 to about 2 cc/g.

The latent base is a di- or trivalent metal compound which has limited solubility in water and which is capable of reacting with a carboxylic acid to form an insoluble carboxylic acid salt. The latent base generally will have a solubility product in water at 25° C. of less than about $10^{-5}$. For example, the latent base may have a solubility product in water of about $10^{-8}$ or less. The latent base may be an alkaline earth metal salt, such as calcium carbonate.

If desired, a fourth layer may overlay the second surface of the first layer. For example, such a layer may be what often is referred to in the papermaking art as a backsize layer. As another example, the fourth layer may be a tie coat, i.e., a coating designed to bind a pressure-sensitive adhesive to the second surface of the second layer. Alternatively, the fourth layer itself may be a pressure-sensitive adhesive. When the fourth layer is a tie coat, a sixth layer consisting of a pressure-sensitive adhesive and overlaying the third layer also may be present.

Moreover, a fifth layer may be present between the first surface of the first layer and the second layer. An example of such a layer is what is known in the papermaking art as a barrier layer.

DETAILED DESCRIPTION OF THE INVENTION

As used herein, the term "nonwoven web" is meant to include any nonwoven web, including those prepared by such melt-extrusion processes as meltblowing, coforming, and spunbonding. The term also includes nonwoven webs prepared by air laying or wet laying relatively short fibers to form a web or sheet. Thus, the term includes nonwoven webs prepared from a papermaking furnish. Such furnish may include only cellulose fibers, a mixture of cellulose fibers and synthetic fibers, or only synthetic fibers. When the furnish contains only cellulose fibers or a mixture of cellulose fibers and synthetic fibers, the resulting web is referred to herein as a "cellulosic nonwoven web." Of course, the paper also may contain additives and other materials, such as fillers, e.g., clay and titanium dioxide, as is well known in the papermaking art.

The term "latex binder" is used herein to mean a dispersion of water-insoluble polymer particles in water. The term "polymer" is intended to encompass both homopolymers and copolymers. Copolymers may be random, block, graft, or alternating polymers of two or more monomers. The polymer typically is a film-forming polymer, such as, by way of illustration only, polyacrylates, styrene-butadiene copolymers, ethylene-vinyl acetate copolymers, nitrile rubbers, poly(vinyl chloride), poly(vinyl acetate), ethylene-acrylate copolymers, and vinyl acetate-acrylate copolymers. Latex binders are well known to those having ordinary skill in the art.

The term "hydrophilic silica" is used herein to mean any amorphous hygroscopic silica having a hydrophilic surface. The hydrophilic surface may be the natural hydrophilic surface characteristic of silica. For example, the silica may be a fumed silica or a precipitated silica. The silica surface may be modified, if desired, provided the modifying agent is hydrophilic. As another example, the silica may be a naturally occurring silica, such as a diatomaceous earth. An example of a diatomaceous earth silica is Celite® 321 (Manville Products Corporation, Denver, Colo.). In general, the average particle size of the silica will be no greater than about 20 micrometers. As practical matter, the average particle size of the silica typically will be in a range of from about 1 to about 20 micrometers. For example, the average particle size may be from about 2 to about 13 micrometers. As another example, the average particle size may be from about 3 to about 9 micrometers.

In addition, the hydrophilic silica generally will have a pore volume greater than 0.4 cc/g. For example, the hydrophilic silica may have a pore volume of from about 1 to about 2 cc/g. As another example, the hydrophilic silica may have a pore volume of from about 1.2 to about 1.9 cc/g. As a further example, the hydrophilic silica may have a pore volume of from about 1.2 to about 1.7 cc/g.

As used herein, the term "latent base" is meant to mean a di- or trivalent metal compound which has limited solubility in water and which is capable of reacting with a carboxylic acid to form an insoluble carboxylic acid salt. The term "limited solubility in water" means that the compound has a solubility product in water at 25° C. of less than about $10^{-5}$. For example, the latent base may have a solubility product in water of about $10^{-8}$ or less. Examples of latent bases include, without limitation, calcium carbonate, calcium oxalate, zinc carbonate, zinc oxalate, aluminum carbonate, and aluminum hydroxide. Desirably, the latent base will be an alkaline earth metal salt. More desirably, the latent base will be calcium carbonate.

The term "viscosity modifier" is used herein to mean a polymer containing carboxylic acid functional groups which, upon neutralization with an alkaline material, cause the polymer chains to either dissolve or swell. Without wishing to be bound by theory, it is believed that, in an alkaline environment, the polymer chains uncoil. The resulting highly extended polymer molecules increase the viscosity of the ink by interacting with the water in the ink formulation. Typical viscosity modifiers are acrylic emulsions.

As used herein, the term "cationic polymer" is meant to include any water-soluble polymer containing cationic functional groups. For example, the cationic polymer may be an amide-epichlorohydrin polymer, a polyacrylamide with cationic functional groups, polyethyleneimine, polydiallylamine, a quaternary polycationic synthetic organic polymer, or the like.

The coated substrate of the present invention includes a first, second, and third layer. The first layer has first and second surfaces. For example, the first layer may be a film or a nonwoven web. Desirably, the first layer will be a cellulosic nonwoven web. For example, the first layer may be a polymer-reinforced paper, sometimes referred to as a latex-impregnated paper. As another example, the first layer may be a bond paper, i.e., a paper composed of wood pulp fibers and cotton fibers. The basis weight of the first layer typically will vary from about 40 to about 300 grams per square meter (gsm). For example, the basis weight of the first layer may be from about 50 to about 250 gsm. As a further example, the basis weight of the first layer may be from about 50 to about 200 gsm.

The second layer overlays the first surface of the first layer. The second layer is composed of from about 25 to about 70 percent by weight of a latex binder, from about 25 to about 65 percent by weight of a hydrophilic silica, from about 1 to about 20 percent by weight of a latent base, and from about 1 to about 4 percent by weight of a water-soluble viscosity modifier, in which all percents by weight are based on the total dry weight of the second layer.

By way of example, the amount of latex binder present in the second layer may be from about 30 to about 50 percent by weight. As another example, the amount of binder present may be from about 30 to about 40 percent by weight. Also by way of example, the amount of hydrophilic silica present in the second layer may be from about 40 to about 60 percent by weight. As a further example, the amount of hydrophilic silica may be from about 45 to about 55 percent by weight.

Also byway of example, the amount of latent base in the second layer may be from about 5 to about 20 percent by weight. As an additional example, the amount of water-soluble viscosity modifier may be from about 1.5 to about 3.5 percent by weight.

The thickness of the second layer typically will be in a range of from about 10 to about 50 micrometers. For example, the thickness of the second layer may be from about 15 to about 45 micrometers. As another example, the thickness of the second layer may be from about 20 to about 40 micrometers.

The second layer generally is formed on the first surface of the first layer by means which are well known to those having ordinary skill in the art. By way of illustration only, the layer may be formed by doctor blade; air knife; Meyer rod; roll, reverse roll, and gravure coaters; brush applicator; or spraying. The second layer typically will be formed from a dispersion. The dispersion generally will have a viscosity of from about 0.005 to about 1 Pa s (5 to 1,000 centipoise) as measured with a Brookfield Viscometer, Model LVT, using a No. 2 spindle at 30 rpm (Brookfield Engineering Laboratories, Inc., Stoughton, Mass.). For example, the dispersion may have a viscosity of from about 0.01 to about 0.5 Pa s (10 to 500 centipoise). As a further example, the dispersion may have a viscosity of from about 0.03 to about 0.25 Pa s (30 to 250 centipoise).

The third layer overlays the second layer and is composed of a water-soluble cationic polymer. The cationic polymer may be, for example, an amide-epichlorohydrin polymer, polyacrylamides with cationic functional groups, polyethyleneimines, polydiallylamines, and the like. The layer typically is formed from an aqueous solution of the cationic polymer. Such solution may be formed by any of the processes described above for formation of the second layer.

In some embodiments, a fourth layer may be present; such layer will overlay the second surface of the first layer. The layer may be, by way of illustration, a backsize coating. Such a coating generally consists essentially of a binder and clay. For example, the binder may be a polyacrylate, such as Rhoplex HA-16 (Rohm and Haas Company, Philadelphia, Pa.). As another example, the clay may be Ultrawhite 90 (Englehard, Charlotte, N.C.). A typical formulation would include the two materials in amounts of 579.7 parts by weight and 228.6 parts by weight, respectively. Water and/or a thickening agent will be added as necessary to give a final dispersion viscosity in the range of 0.100–0.140 Pa s (100–140 centipoise) at ambient temperature.

Also by way of illustration, the fourth layer may be a tie coat, i.e., a coating designed to bind a pressure-sensitive adhesive to the second surface of the first layer. A typical tie coat consists of a polyacrylate binder, clay, and silica. Alternatively, the fourth layer itself may be a pressure-sensitive adhesive. For example, a pressure-sensitive adhesive layer may consist of a styrene-butadiene copolymer, a poly(vinyl acetate), or a natural rubber. A pressure-sensitive adhesive layer typically will be present at a basis weight of from about 10 to about 40 gsm. When the fourth layer is a tie coat, a sixth layer consisting of a pressure-sensitive adhesive and overlaying the fourth layer also may be present.

In addition to or in place of the fourth layer, a fifth layer may be present. The fifth layer usually will be located between the first and second layers. The fifth layer typically will be formed from a dispersion consisting of, by way of example only, 208 parts by weight of Hycar® 26084 (B. F. Goodrich Company, Cleveland, Ohio), a polyacrylate dispersion having a solids content of 50 percent by weight (104 parts dry weight), 580 parts by weight of a clay dispersion having a solids content of 69 percent by weight (400 parts dry weight), and 100 parts by weight of water. Additional water and/or a thickening agent may be added as necessary to give a final dispersion viscosity in the range of 0.100–0.140 Pa s (100–140 centipoise) at ambient temperature.

The present invention is further described by the examples which follow. Such examples, however, are not to be construed as limiting in any way either the spirit or the scope of the present invention.

In the examples, all ink jet printing evaluations were done using a Desk Jet 550 C color ink jet printer, Model C2121A, from Hewlett Packard Company, Camas, Wash. Three different test patterns were used to evaluate print sharpness, rate of ink drying, brilliance of color and water resistance of the printed image. The first test pattern consisted of black fonts and a large solid-printed "C". The black fonts were used to evaluated the sharpness and degree of feathering of the print. The large solid-printed "C" was used to evaluate ink coverage and evenness of application. It was also used to evaluate drying times and water and moisture resistance of the various coating compositions. A multi-colored series of printed bars, and a multi-colored graphic ("Happy Birthday") were used to evaluate color brilliance, feathering, and water resistance of the colored ink jet inks.

EXAMPLE 1

A polypropylene synthetic printing paper, Kimdura® FPG-110 Synthetic Printing Paper from Kimberly-Clark Corporation, Roswell, Ga., was used as the base substrate or first layer. One side of the synthetic paper was coated with a composition consisting of 48 percent by weight (75 parts by weight) of a silica having an average particle size of 7.5 micrometers (Syloid 74×3500, W. R. Grace Company, Baltimore, Md.), 16 percent by weight (25 parts by weight) calcium carbonate (M-60, Mississippi Lime Company, Alton, Ill.), 32 percent by weight (50 parts by weight) latex binder (Hycar® 26084, a polyacrylate available from B. F. Goodrich Company, Cleveland, Ohio) and 3 percent by weight (5 parts by weight) of a viscosity modifier (Acrysol ASE-95NP, a polyacrylic acid rheology modifier available from Rohm & Haas Company, Philadelphia, Pa.). The coating was applied at a basis weight of 15 grams per square meter (gsm) using a Meyer Rod and formed the second layer upon drying in a forced hot air oven at 95° C. (Blue M Electric Stabil-Therm Oven, General Signal Company, Blue Island, Ill.).

After drying, the second layer was over-coated with a 6.8 percent by weight aqueous solution of a cationic polymer, an amide-epichlorohydrin copolymer (Reten 204LS supplied by Hercules Inc., Wilmington, Del.), using a No. 6 Meyer Rod. Because the amount of cationic polymer applied was very small, the basis weight of the coating or third layer was not determined. The third layer was dried as described above for the second layer.

The resultant coated substrate was printed with the three test patterns described above to give sharp, clear (no feathering) graphic and font images with brilliant colors which did not bleed when exposed to moisture and water. Image quality and feathering were judged visually. Moisture and water resistance were tested by placing drops of water on the various colors of the printed image, waiting approximately 10 seconds, and then wiping with a facial tissue. The black, cyan and yellow inks were very water resistant and none came off on the tissue. The magenta ink bled to a very small degree, a light red smudge being evident on the tissue. The printed sheet also was held under running water from a faucet for approximately 30 seconds with no bleeding of the black, cyan, and yellow inks. A small amount of the magenta ink bled into the surrounding coating under this condition.

EXAMPLE 2

Silicas are commercially available in many different particle sizes, pore volumes, and oil absorption capacities. Accordingly, in order to evaluate a number of such silicas, the procedure of Example 1 was repeated, except that the viscosity modifier was replaced with 1.6 percent by weight, based on the total weight of the second layer, of Acrysol ASE-60 (a polyacrylic acid rheology modifier available from Rohm & Haas Company, Philadelphia, Pa.) and ten different silicas were employed in as many trials, one silica per trial. The silicas studied were as follows:

Silica A

Silica A was Syloid 244 (W. R. Grace Company, Baltimore, Md.). The material is reported to have an average particle size of 3 micrometers and a pore volume of 1.4 cubic centimeters per gram (cc/g).

Silica B

This silica was Syloid 74×3500, the silica employed in Example 1. The material is reported to have an average particle size of 7.5.micrometers and a pore volume of 1.2 cc/g.

Silica C

Silica C was Mizukasil P-78A (Mizusawa Industrial Chemicals, Ltd., Japan, available from Performance Chemicals, Inc., DePere, Wis.). The material is reported to have an average particle size of 3.5 micrometers and a pore volume of 1.5 cc/g.

Silica D

Silica D was Syloid AL-1 (W. R. Grace Company, Baltimore, Md.). The material is reported to have an average particle size of 7 micrometers and a pore volume of 0.4 cc/g.

Silica E

This silica was Syloid 74×6500 (W. R. Grace Company, Baltimore, Md.). The material is reported to have an average particle size of 3.5 micrometers and a pore volume of 1.2 cc/g.

Silica F

This silica was Syloid 74 (W. R. Grace Company, Baltimore, Md.). The material is reported to have an average particle size of 6 micrometers and a pore volume of 1.2 cc/g.

Silica G

Silica G was Mizukasil P-78F (Mizusawa Industrial Chemicals, Ltd., Japan, available from Performance Chemicals, Inc., DePere, Wis.). The material is reported to have an average particle size of 13 micrometers and a pore volume of 1.7 cc/g.

Silica H

This silica was Mizukasil P-78D (Mizusawa Industrial Chemicals, Ltd., Japan, available from Performance Chemicals, Inc., DePere, Wis.). The material is reported to have an average particle size of 8 micrometers and a pore volume of 1.6 cc/g.

Silica I

Silica I was Dev A SMR3-670 (W. R. Grace Company, Baltimore, Md.). The material is reported to have an average particle size of 9 micrometers and a pore volume of 1.9 cc/g.

Silica J

This Silica was W500 (W. R. Grace Company, Baltimore, Md.). The material is reported to have an average particle size of 5 micrometers and a pore volume of 1.5 cc/g.

The results of the ten trials are summarized in Table 1. In the table, the "Ave. Size" column is the reported average particle size in micrometers and the "Pore Vol." column is the reported pore volume in cc/g.

TABLE 1

Summary of Trials with Different Silicas

| Trial | Silica | Ave. Size | Pore Vol. | Printing Evaluation |
|---|---|---|---|---|
| 2-1 | A | 3.0 | 1.4 | Fair |
| 2-2 | B | 7.5 | 1.2 | Very good |
| 2-3 | C | 3.5 | 1.5 | Fair |
| 2-4 | D | 7.0 | 0.4 | Poor |
| 2-5 | E | 3.5 | 1.2 | Fair |
| 2-6 | F | 6.0 | 1.2 | Good |
| 2-7 | G | 13.0 | 1.7 | Fair |
| 2-8 | H | 8.0 | 1.6 | Good |
| 2-9 | I | 9.0 | 1.9 | Fair |
| 2-10 | J | 5.0 | 1.5 | Very good |

The data in Table 1 suggest that silica particle size and pore volume are important to obtain clear, sharp images with ink jet printing. Coatings made with silica pigments having particle sizes between about 5 and about 8 micrometers and pore volumes greater than 0.4 cc/g gave the best print results. Note that poor results were achieved with a silica having a pore volume of 0.4 cc/g, even though the average particle size was 7.0 micrometers (see Trial 2–4).

Larger particle size silica pigments typically resulted in poorer print quality and a sheet which is rough to the touch; see, e.g., Trial 2–7. Conversely, the use of silica pigments with smaller particle sizes yielded a smooth-feeling sheet, but only fair print quality. See, for example, Trial 2–3.

EXAMPLE 3

A number of rheology modifiers were investigated as ink viscosity modifiers to control feathering of the ink. High molecular weight poly(oxyethylenes) were not satisfactory because they immediately turned the silica-containing coating compositions to a putty-like consistency. Cellulose gums, such as methylcellulose and hydroxyethylcellulose, were tried but did satisfactorily stop feathering of the ink.

The ink viscosity modifiers which controlled feathering of the ink best were polyacrylic acid rheology modifiers, e.g., the Acrysol polymers from Rohm & Haas Company, Philadelphia, Pa. Accordingly, Acrysol ASE-60, ASE-75, and ASE-95NP were evaluated over a range of concentrations from about 1.6 percent by weight to about 3.8 percent by weight, based on the total weight of the coating or second layer. For convenience, such viscosity modifiers will be referred to hereinafter as Modifiers A, B, and C.

The viscosity modifiers were evaluated by repeating Example 1 and varying the viscosity modifier and/or the viscosity modifier concentration in the composition. That is, the parts by weight of silica, calcium carbonate, and binder were maintained in each trial at 75, 25, and 50, respectively. The results are summarized in Table 2. In the "Smear" (for smearing) and "Discolor" (for discoloration) columns under the "Water Resistance" heading, "S" represents "Slight" and "VS" represents "Very Slight."

TABLE 2

Summary of Trials vith Different Types and Levels Of Viscosity Modifiers

| | Viscosity Modifier | | | Printing | Water Resistance | |
|---|---|---|---|---|---|---|
| Trial | Type | Parts | Percent | Evaluation | Smear | Discolor |
| 3-1 | A | 2.5 | 1.6 | Good | S | None |
| 3-2 | A | 3.0 | 2.0 | Very good | VS | S |
| 3-3 | A | 3.5 | 2.3 | Good | S | None |
| 3-4 | B | 2.5 | 1.6 | Poor | None | None |
| 3-5 | B | 3.0 | 2.0 | Fair | None | None |
| 3-6 | B | 3.5 | 2.3 | Poor | S | None |
| 3-7 | B | 4.0 | 2.6 | Good | VS | None |
| 3-8 | B | 5.0 | 3.2 | Poor | VS | None |
| 3-9 | C | 2.5 | 1.6 | Fair | S | None |
| 3-10 | C | 3.0 | 2.0 | Good | VS | None |
| 3-11 | C | 3.5 | 2.3 | Very good | S | None |
| 3-12 | C | 4.0 | 2.6 | Excellent | VS | None |
| 3-13 | C | 5.0 | 3.2 | Excellent | S | None |
| 3-14 | C | 6.0 | 3.8 | Excellent | S | None |

As Table 2 shows, all three viscosity modifiers gave at least good control of feathering of the ink at least one concentration. The Acrysol ASE-95NP at 3.8 percent by weight gave the best results, as also illustrated by Example 1.

EXAMPLE 4

The choice of base used to form the carboxylate salt of the polyacrylic acid viscosity modifier had a dramatic effect on the control of feathering and the water resistance of the ink jet inks. The procedure of Example 1 was repeated, except that the second layer consisted of a mixture of Silica A (Syloid 244 from W. R. Grace Company), a polyacrylate latex binder (Hycar 26084 from B. F. Goodrich Company), and base. The parts by weight on a dry weight basis of silica and latex binder in each case were 100 and 50, respectfully. In each case, the third layer was formed over the second layer as described in Example 1.

For Trial 4-1, 6.3 percent by weight of Modifier A from Example 3, a polyacrylic acid rheology modifier (Acrysol ASE-60 from Rohm & Haas Company) was included in the second layer. No base was added. Printed sheets gave unacceptable feathering of the inks.

In Trial 4-2, 2.0 percent by weight of Acrysol ASE-60 was included and the pH of the resulting coating mixture was raised to 8.0 with sodium hydroxide solution. This sheet gave sharp, clear printing without feathering. However, the water resistance of the inks were unacceptable on this sheet.

In Trial 4-3, 2.3 percent by weight of Acrysol ASE-60 was included in the second layer; the pH of the resulting latex mixture was raised to 8.6 with ammonium hydroxide solution. This sheet gave unacceptable feathering of the ink. The results were the same as with Trial 4-1. It is believed that the ammonium hydroxide was driven out of the coating on drying. Consequently, the polyacrylic acid viscosity modifier does not remain in the carboxylate salt or thickened form on drying of the coating.

Finally, in Trial 4-4 1.8 percent by weight of Acrysol ASE-60 and 16 percent by weight of calcium carbonate, a water-insoluble latent base, was added to the second layer coating composition. The sheets coated with this composition gave sharp, clear prints with good water resistance. The calcium carbonate apparently slowly reacted with the carboxylic acid groups of the viscosity modifier (the pH increased from 6 to 8) to form water-insoluble calcium carboxylate salt groups which control feathering and do not interfere with the insolubility of the dyes.

EXAMPLE 5

The level of latex binder used in the base coat is important to obtaining clear, sharp printing and to effectively bond the coating to the base substrate. If too little latex binder is used the coating bonds poorly to the substrate or first layer. If too much latex is used the coating becomes nonporous and will not rapidly adsorb the water in the ink, causing poor print quality. Accordingly, experiments were conducted to determine the effect of varying the latex binder level in the second layer from about 33 percent by weight to about 67 percent by weight, based on the total weight of the second layer. In each case, the silica and latex binder were the same as those employed in Example 1. The results are summarized in Table 3, which includes the results of the Dennison Wax Pick Method.

In addition to the ink jet printer testing described in Example 1, the coated substrates were evaluated by the Dennison Wax Pick Method, ASTM Method D2482-66T, Dennison Standard Paper Testing Waxes Series 39-330. Such waxes are designed with graduated degrees of adhesion, with lower numbers having low adhesion and higher numbers having higher adhesion. Thus, a coating that "picks" with a higher number wax is a stronger coating with respect to coating adhesion strength.

TABLE 3

Summary of Silica/Binder Ratio Studies

| Trial | Parts Silica | Parts Binder | Percent Binder | Printing Evaluation | Wax Pick |
|---|---|---|---|---|---|
| 5-1 | 100 | 50 | 33 | Good | 6 |
| 5-2 | 100 | 75 | 43 | Poor | 9 |
| 5-3 | 75 | 75 | 50 | Poor | 10 |
| 5-4 | 100 | 100 | 50 | Poor | 9 |
| 5-5 | 50 | 100 | 67 | Poor | 10 |

The table shows that the use of 33 percent by weight latex binder, based on total coating weight, gave the best balance of printing properties and bonding of the coating or second layer to the substrate or first layer.

EXAMPLE 6

The amount of cationic polymer added as the third layer was too small to be measurable by weight differences, but is still important to obtaining good water resistance of the ink jet inks. If no cationic polymer third layer is used, the inks can be removed from the second layer with water. When the third layer consisted of a 4.9 weight percent solution of Reten 204LS applied with a No. 6 Meyer Rod, the water resistance was much improved compared to the absence of the third layer, but the inks still bled when drops of water were applied to the printed surface and then wiped off with a facial tissue. Use of a 6.8 weight percent solution of Reten 204LS as described in Example 1 resulted in good water resistance.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A coated substrate comprising:

a first layer substrate having first and second surfaces;

a second layer coating overlaying the first surface of the first layer substrate, which second layer coating is comprised of:

from about 25 to about 70 percent by weight of a latex binder;

from about 25 to about 65 percent by weight of a hydrophilic silica having an average particle size of less than about 20 micrometers and a pore volume greater than 0.4 cc/g;

from about 1 to about 20 percent by weight of a latent base; and from about 1 to about 4 percent by weight of a water-soluble polyacrylate viscosity modifier;

all based on the total dry weight of the second layer; and a third layer coating overlaying the second layer coating, which third layer coating is comprised of a water-soluble cationic polymer.

2. The coated substrate of claim 1, in which the amount of latex binder in the second layer coating is from about 30 to about 50 percent by weight.

3. The coated substrate of claim 1, in which the amount of hydrophilic silica in the second layer coating is from about 40 to about 60 percent by weight.

4. The coated substrate of claim 1, in which the hydrophilic silica has an average particle size of from about 1 to about 20 micrometers.

5. The coated substrate of claim 4, in which the hydrophilic silica has an average particle size of from about 2 to about 13 micrometers.

6. The coated substrate of claim 1, in which the amount of latent base in the second layer coating is from about 5 to about 20 percent by weight, based on the total dry weight of the second layer coating.

7. The coated substrate of claim 1, in which the amount of viscosity modifier in the second layer coating is from about 1.5 to about 3.5 percent by weight.

8. The coated substrate of claim 1, in which the latent base is an alkaline earth metal salt.

9. The coated substrate of claim 8, in which the latent base is calcium carbonate.

10. The coated substrate of claim 1, in which the first layer substrate is a film or a nonwoven web.

11. The coated substrate of claim 10, in which the first layer substrate is a cellulosic nonwoven web.

* * * * *

UNITED STATES PATENT AND TRADEMARK OFFICE

CERTIFICATION OF CORRECTION

PATENT NO. : 5,660,928

DATED : August 26, 1997

INVENTOR(S): Bruce G. Stokes and Francis J. Kronzer

It is certified that error appears in the above-identified patent and that said Letters Patent is hereby corrected as shown below:

Column 4, line 45, "byway" should read --by way--;
Column 8, line 36, "vith" should read --with--;
Column 8, line 37, "Of" should read --of--.

Signed and Sealed this

Ninth Day of December, 1997

*Attest:*

*Attesting Officer*

BRUCE LEHMAN

*Commissioner of Patents and Trademarks*